US008316624B2

(12) United States Patent
Prakken

(10) Patent No.: US 8,316,624 B2
(45) Date of Patent: Nov. 27, 2012

(54) CASSETTE FOR RECEIVING FLEXIBLE PACKS, AS WELL AS METHOD FOR THE FORMATION OF A GROUP OF PACKS

(75) Inventor: Nicolaas Martin Prakken, Chester, VA (US)

(73) Assignee: Blueprint Holding B.V., Woerden (NL)

( * ) Notice: Subject to any disclaimer, the term of this patent is extended or adjusted under 35 U.S.C. 154(b) by 252 days.

(21) Appl. No.: 12/162,360

(22) PCT Filed: Jan. 26, 2006

(86) PCT No.: PCT/NL2006/050016

§ 371 (c)(1),
(2), (4) Date: Jul. 28, 2008

(87) PCT Pub. No.: WO2007/086725

PCT Pub. Date: Aug. 2, 2007

(65) Prior Publication Data

US 2009/0013641 A1 Jan. 15, 2009

(51) Int. Cl.
*B65B 35/50* (2006.01)
*B65B 35/30* (2006.01)

(52) U.S. Cl. ..... 53/447; 53/540; 53/535

(58) Field of Classification Search ..... 53/443, 53/446, 447, 150, 155, 535, 537, 540, 544
See application file for complete search history.

(56) References Cited

U.S. PATENT DOCUMENTS

| | | | | |
|---|---|---|---|---|
| 2,270,820 | A | 1/1942 | Kaliska | |
| 2,312,651 | A | 3/1943 | Koolnis | |
| 4,864,801 | A | 9/1989 | Fallas | |
| 5,924,533 | A * | 7/1999 | Cnockaert et al. | 190/18 A |

FOREIGN PATENT DOCUMENTS

| | | | |
|---|---|---|---|
| FR | 2 754 239 | A | 4/1998 |
| JP | 59-163102 | A | 9/1984 |
| WO | 2006/055319 | A1 | 5/2006 |

OTHER PUBLICATIONS

Definition of "robot"; merriamwebster.com Aug. 3, 2009.*

* cited by examiner

*Primary Examiner* — Rinaldi I. Rada
*Assistant Examiner* — John Paradiso
(74) *Attorney, Agent, or Firm* — Young & Thompson

(57) ABSTRACT

Cassette system with cassette (17, 27, 37, 47) and method for grouping a number of flexible packs (10). It is proposed that the cassette be produced from two parts which are hinged with respect to one another, one or more flexible packs being placed in each part. The parts of the cassette with the flexible pack or flexible packs placed thereon are then moved relative to one another, and more particularly are rotated, in order thus to obtain a group of packs where the packs lie close together. The group thus obtained is then placed in an outer pack such as a box.

25 Claims, 3 Drawing Sheets

6
11
14
10
13
7
12
14
13

15
16

18

25
26
26
26
26
25

28

32
33
23
21
24
17
22
31

34

27

37

47
52
52

53

51

CASSETTE FOR RECEIVING FLEXIBLE PACKS, AS WELL AS METHOD FOR THE FORMATION OF A GROUP OF PACKS

BACKGROUND OF THE INVENTION

1. Field of the Invention

The present invention relates to a cassette for receiving a number of flexible packs, the formation of said packs into a group and delivery of said group into an outer pack, wherein different parts of said cassette can be moved relative to one another from a pick-up position when receiving said flexible packs to a formation position for the formation of said group of packs.

2. Description of the Related Art

Such a cassette is disclosed in U.S. Pat. No. 4,864,801. This publication describes the formation of a group of packs by placing one or more rows of packs next to one another in an upright position in a cassette. A side wall of the cassette is made so that it can rotate and after filling of the cassette the packs lying in a slightly slanting position are placed in a straight position. The bottom of the cassette is then swung to one side and the flexible packs move into an outer pack such as a box.

During the packing of flexible packs such as packs for potato crisps, snacks and other products the problem is that the outer pack cannot always be filled in the optimum manner because of the changing shape of the flexible pack. On the other, hand, in the case of many products it is not possible to remove bulges in flexible packs by applying pressure because the product in the flexible packs could be damaged as a result of this.

In shops products are increasingly being sold from the box. That is to say, a group of products is placed directly on the shelf from the box, or a large part of the box is opened, so that the consumer can remove the products. In such a case it is important for the consumer to see immediately that part of the pack that most arouses the desire to purchase. For that reason, bearing this objective in mind, it is necessary when packing different rows of packs in a group to take into account the orientation when introducing the flexible packs into the same box. It may be necessary in this case for certain flexible packs to be oriented in a different way from the rest of the flexible packs.

SUMMARY OF THE INVENTION

The aim of the present invention is to eliminate the above-mentioned problems.

This aim is achieved according to a first aspect of the invention with a cassette of the type described above.

According to the invention provision is made for a placing position and a formation position, which can be the transfer position. Owing to the fact that these positions differ from one another, the flexible pack can be put in the optimum position for placing and arranged in formation and transferred in the optimum position for putting into an outer pack.

For instance, in a particular variant of the present invention it is possible to position the flexible packs horizontally in the pick-up position. That is to say, in contrast to the state of the art, there is no longer the risk of the contents "bulging", but the product will naturally be distributed uniformly over the whole pack during the placing operation. By positioning the packs in two positions, it is also easily possible to make the most important side of a flexible pack different in each of those two pick-up positions. According to the present invention, each of the pick-up positions is then changed and the sub-groups consisting of the packs that have been placed in the pick-up position are moved towards one another. During the movement towards one another further packs can be added. It is, however, also possible to arrange packs in a specific orientation earlier, that is to say before they are put in the pick-up position, and it is moreover possible after formation of the sub-groups to add to the group thus obtained by putting in further packs. These different packs which are not included in the sub-groups can have a different orientation. In this way the capacity of an outer pack can be utilized in the optimum manner and, for example, provision can be made there is always a pack on the outside of a group of packs which has the part with the most relevant information facing the person who opens the pack.

According to a further aspect, the present invention relates to a cassette for receiving a number of flexible packs, the formation of said packs into a group and delivery of said group into an outer pack, wherein different parts of said cassette can be moved relative to one another from a pick-up position when receiving said flexible packs to a formation position for the formation of said group of packs, wherein in the transfer position said cassette comprises a bottom and two opposing side walls, wherein said bottom comprises two bottom parts that can be moved relative to one another, wherein each side wall is joined to a bottom part. According to this aspect of the present invention, which can be used independently of the first aspect, provision is made for at least two pick-up positions for the flexible packs from a feed facility. In this position [sic] the packs can be positioned in the optimum way.

By rotation through at least 60° and preferably by rotation through at least 80° and more particularly approximately 90°, an essentially different orientation of the packs is obtained, with the result that the force of gravity acts in an essentially different direction.

According to the present invention the pick-up position is obtained by a combination of a side wall and a bottom part. This preferably forms a sort of scoop-like construction, by means of which it is possible to place a sub-group of packs from a first pick-up position in a second formation position. According to a particular embodiment of the invention this formation position is also the delivery position. Transfer can be realised by, for example, moving the formed group of packs along the bottom of the cassette using a pushing member. Other ways of moving the group of flexible packs formed according to the invention are also possible. For instance, it is possible for the bottom parts to yield in some way, as a result of which the packs move downwards by the force of gravity. It is also possible for the group to be gripped laterally and, for example, to be removed upwards. Another possibility is that after formation of the group the cassette, and more particularly the parts described above, such as the bottom parts and side wall parts, perform a further movement so as to move into a transfer position.

According to a particular embodiment of the invention the bottom parts perform a rotational movement. For this purpose they can be attached to one another by some mechanism, such as a rod mechanism or roller/groove mechanism. According to a preferred embodiment, the bottom parts are either hinged to one another or hinged to a support plate located between them. More complex movements consisting of a combination of a rotation and translation are also possible. In this context, one example that can be mentioned is movement of the bottom parts in the linear direction relative to one another. These can move towards one another or away from one another during the orientation from the pick-up position to the formation position. Further packs can be fed in during this movement.

According to a further advantageous embodiment of die invention the bottom parts and/or side walls are provided with gripping means such as suction cups for flexible packs. This is particularly important if movement of the flexible packs adjacent to the bottom parts or side walls is undesirable and there are concerns about this risk.

The present invention also relates to a system for packing flexible packs, wherein the cassette described above is used in combination with a feed for packs and a carrier for the outer packs. According to a particular embodiment a robot can be provided in the feed. More particularly, the robot is of a multiple design, that is to say the sub-groups concerned are formed simultaneously in the cassette.

The invention also relates to a method for packing flexible packs.

According to yet a further aspect, the present invention relates to a method for packing flexible packs, comprising placing packs in a cassette and forming a group of packs by moving said packs inside said cassette and transferring the group thus formed into an outer pack, wherein said flexible packs are placed in said cassette in two sub-groups with different orientations, and said sub-groups are moved towards one another. If the movement of said sub-groups comprises a rotation, the rotation of the sub-groups concerned is at least approximately 45° relative to one another.

BRIEF DESCRIPTION OF THE DRAWING FIGURES

The invention will be explained in more detail below with reference to the illustrative embodiments shown in the drawing, in which:

FIG. 1 shows diagrammatically die system according to the invention, incorporating the cassette according to the invention;

FIGS. 2*a*-2*c* show a detail of the cassette shown in FIG. 1 in different positions;

FIGS. 3*a*-3*c* show the cassette shown in FIG. 2 loaded in different ways;

FIGS. 4*a*-4*c* show an alternative to the cassette shown in FIGS. 1-3;

FIG. 5 shows a further embodiment of the cassette according to the present invention;

FIGS. 6*a*-6*c* show a variant of the cassette shown in FIGS. 4*a*-4*c*; and FIG. 7 shows a further variant of the cassette according to the invention.

DETAILED DESCRIPTION OF THE INVENTION

A system according to the present invention is shown by 1 in FIG. 1. This consists of a feed conveyor 2, by means of which flexible packs 10 containing some product, such as bags of potato crisps, are fed. Downstream of this conveyor is a robot indicated by 3, where the arm 4 of which is provided on both ends with suction cups 5 for picking up packs. Reference numeral 7 indicates a cassette, the details of which will be described below. A pusher plate 6 and an outer pack or box 8 placed on the opposite side of the cassette 7 interact with the cassette. For the sake of clarity, this box is shown open at the rear/bottom. This box is held in place by means of a device 9 not shown in detail.

The mode of operation of the cassette 7 according to FIG. 1 will be explained with reference to FIG. 2. It can be seen from FIGS. 2*a*-*c* that the cassette 7 consists of two bottom parts 12 that are hinged to one another by means of a hinge 11. Adjacent to the bottom parts 12, side wall parts 13 are fitted in a fixed manner on the bottom parts in each case. It will be understood that this join can also be made in a hinged manner.

With robot 3 as shown in FIG. 1, two flexible packs 10 are taken from a feed conveyor 2 in each case and placed in the cassette 7. With this arrangement, the flexible packs rest on the side wall parts 13 and they may possibly lean somewhat against the bottom parts 12 positioned at a slight angle relative to the vertical. By repeated action of robot 3, two sub-groups 14 are formed, as shown in FIG. 2*a*. A pivoting movement of the cassette parts 15 and 16 then occurs, causing the sub-groups to be moved towards one another. After the side wall parts are essentially vertical, further flexible packs 10 are fed in by robot 3, without the setting thereof having to be radically changed. A group 18 is produced in tins way. In addition, the orientation of the packs can be influenced by the method of packing. Moreover, the packs always remain as far as possible in the horizontal position, which as far as possible prevents their contents from sinking towards the bottom. Furthermore, the bags can be pressed against one another or even squeezed slightly, which impedes sinking of the contents and permits maximum utilisation of the outer pack.

FIGS. 3*a*-3*c* show a variant of the formation of a group according to FIG. 1. In this variant each sub-group 25 consists of two rows 26, which results in a group 28 consisting of two layers, in the case of which, as shown in FIG. 2*c*, yet a third layer, consisting of four packs placed on the two sub-groups, can be put in the group.

FIGS. 4*a*-4*c* show a variant of the cassette according to the invention. In this case the bottom parts 22 are connected by means of a hinge 21 to a support plate 24 positioned between them. Side wall parts 23 are adjacent to the bottom parts 22. This variant of the cassette is indicated by 17. As can be seen from FIG. 4*a*, three sub-groups of packs are made that are indicated by 31, 32 and 33. By the tilting movement of the bottom parts with side wall parts, the orientation of the sub-groups 31 and 33 will be changed and ultimately the group 34 as shown in FIG. 4*c* will be produced.

Figure 1:
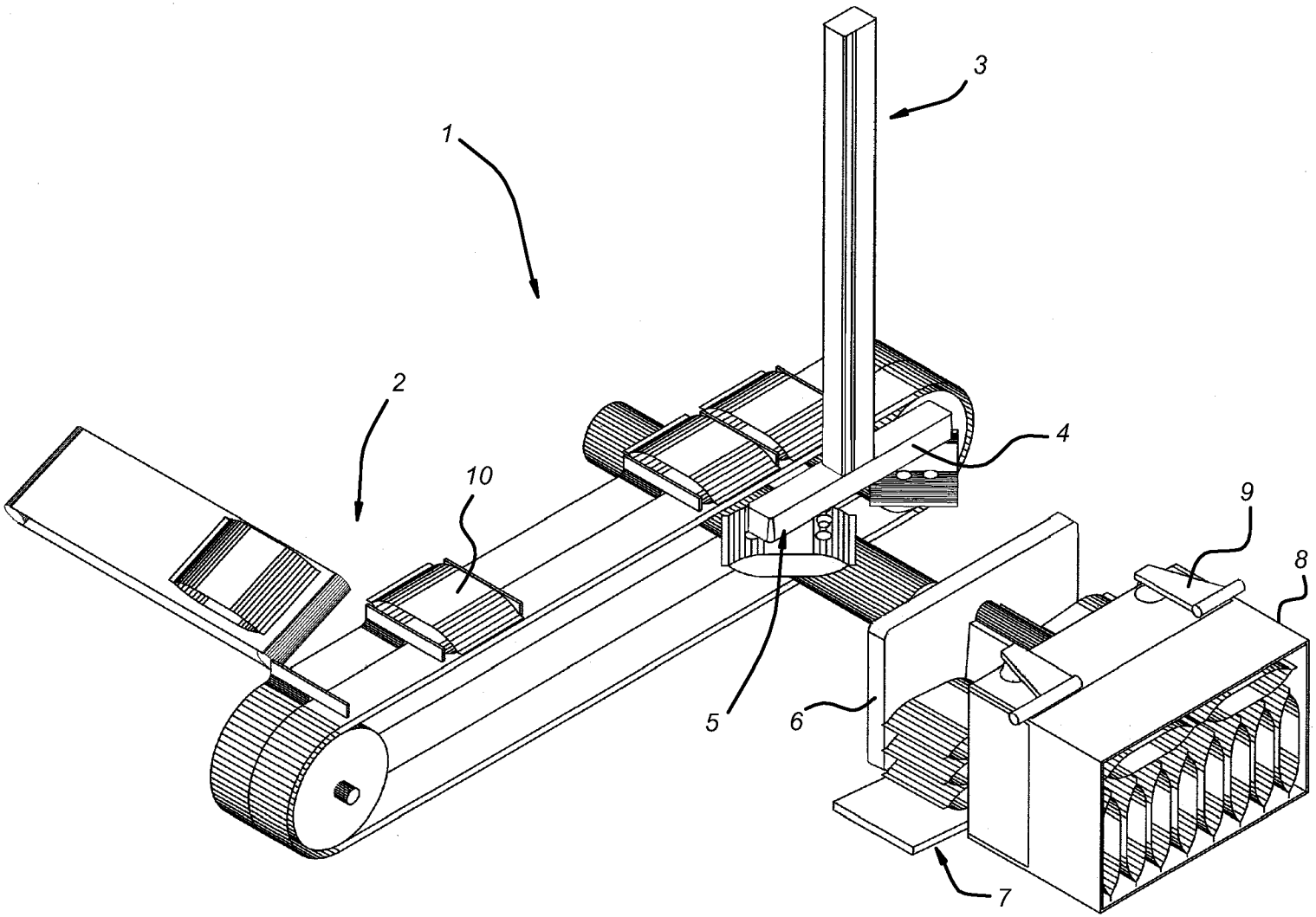
Figures 2A, 2B, 2C, 3A, 3B, 3C, 4A, 4B, 4C:
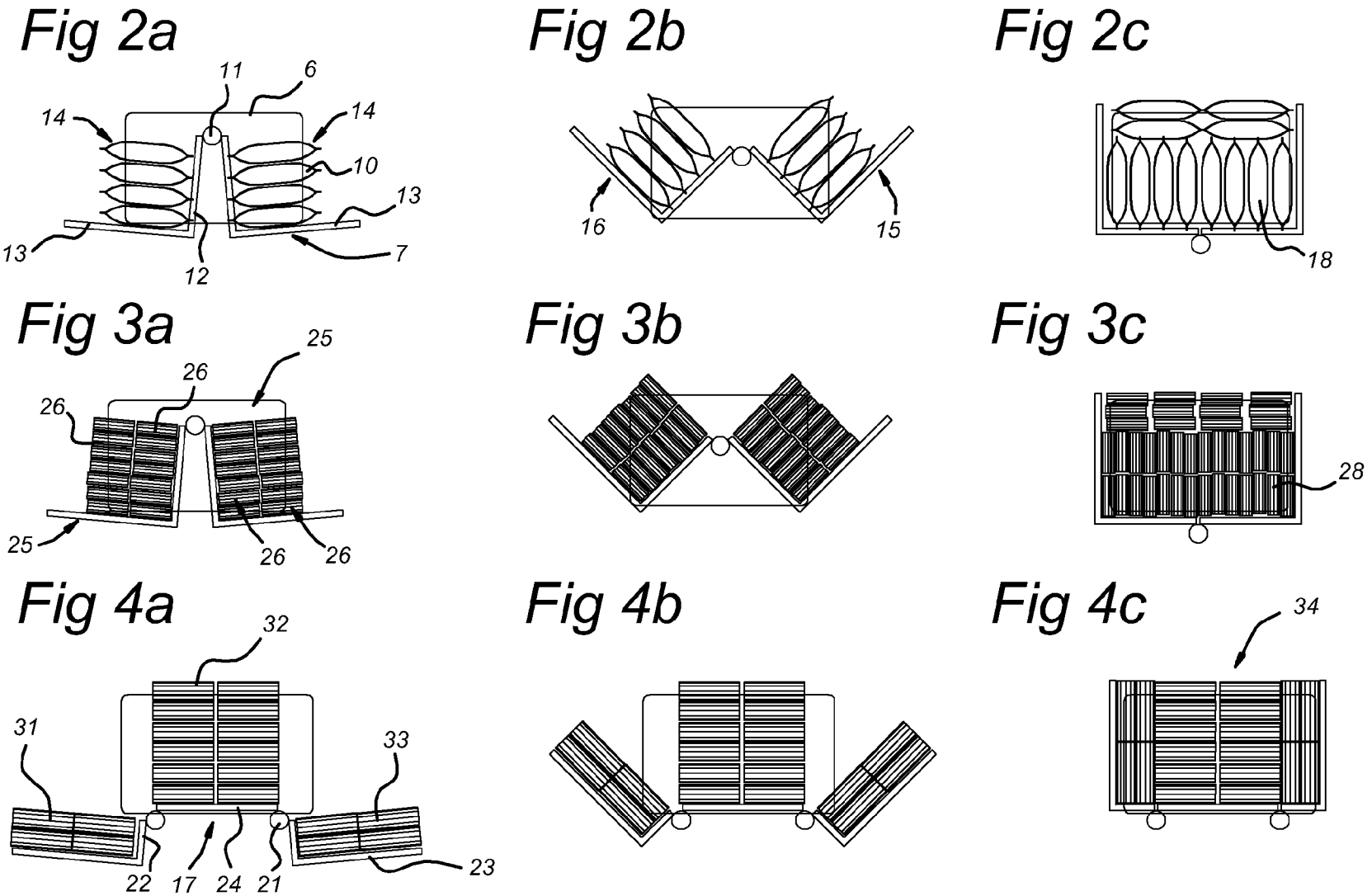
Figures 5A, 5B, 5C, 6A, 6B, 6C, 7A, 7B, 7C:
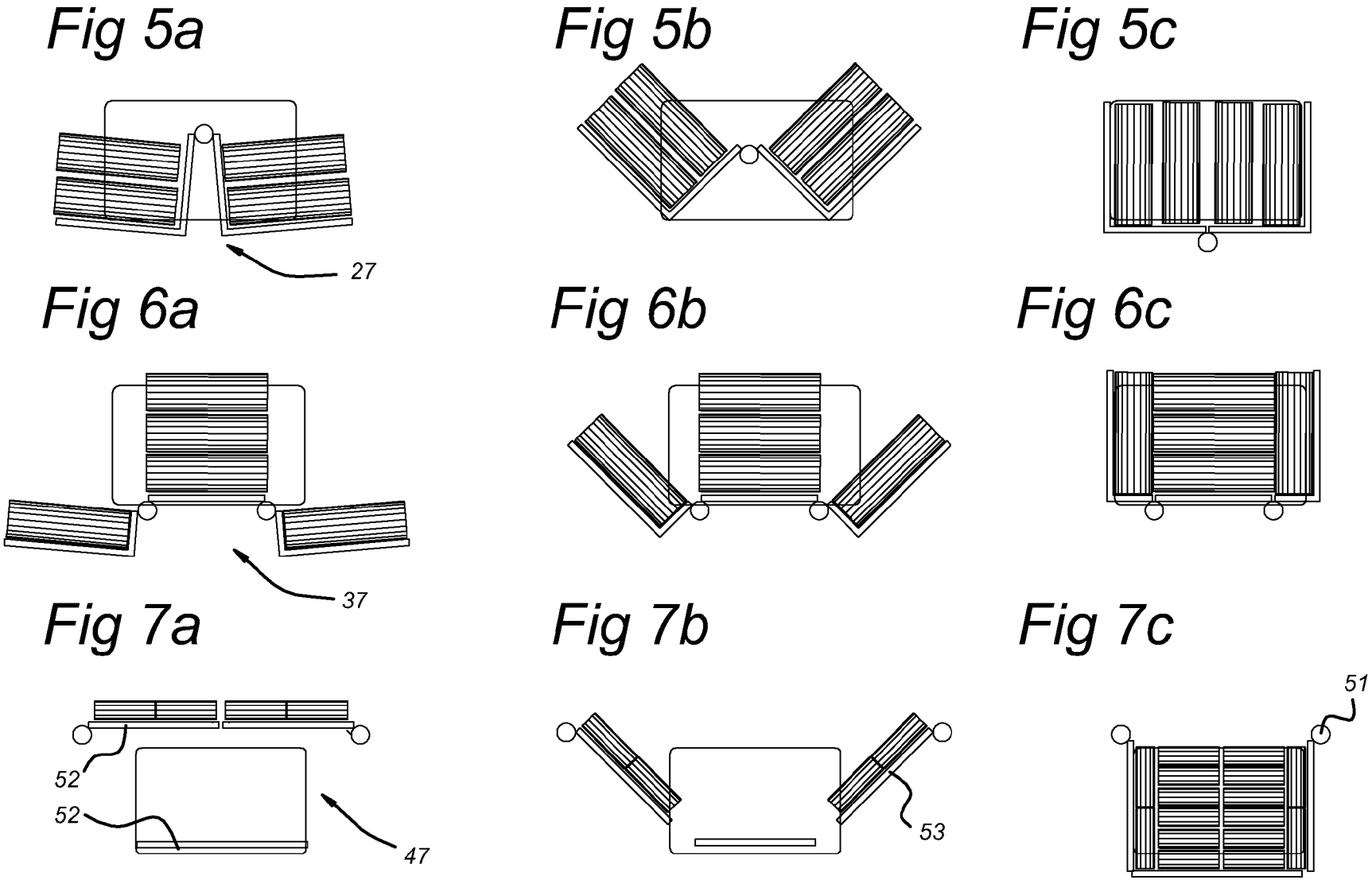
FIG. 5 shows a further variant, the cassette being indicated in its entirety by 27.
FIG. 6 shows a further variant of the construction shown in FIG. 4, which is indicated in its entirety by 37.

FIG. 7 shows a cassette 47 consisting of a fixed bottom part 52 and two hinged side wall parts 53. These side wall parts can be moved between a first or pick-up position as shown in FIG. 7*a* to a transfer position as shown in FIGS. 7*b* and 7*c*. In the pick-up position the side wall parts 53 constitute a supporting surface for packs and after the side wall parts 53 have been pivoted the group such as shown in FIG. 7*c* is produced. In all of the above embodiments there may optionally be suction cups or the like for holding the flexible packs against the side wall parts and/or bottom parts.

Variants of the invention will immediately be apparent to those skilled in the art after reading the above description. Such variants can consist of combinations of what has been described above or combinations with other movements known in the state of the art. This relates in particular to the movement of the cassette as a whole into one of the positions shown here and the performance of a further movement of the bottom parts. These and further variants fall within the scope of the appended claims. In addition, rights are expressly requested for variants that fall exclusively under the sub-claims.

The invention claimed is:

1. A method for packing a plurality of flexible packs, comprising:

placing the plurality of flexible packs from a feed in a cassette at a placing position; forming a group of packs by moving said plurality of flexible packs inside said cassette to a formation position; and transferring the group thus formed from said cassette into an outer pack, wherein said plurality of flexible packs undergo a rotational movement through an angle of at least 60° from said placing position to said formation position.

2. The method according to claim 1, wherein said plurality of flexible packs are placed in said cassette in two sub-groups, each with different orientations, and said sub-groups are moved towards one another at said formation position.

3. The method according to claim 1, wherein said sub-groups are moved towards one another until they are in essentially the same orientation.

4. The method according to claim 1, wherein after movement of said sub-groups a further flexible pack is added to the group thus formed.

5. The method according to claim 1, wherein said cassette comprises a bottom and a plurality of side walls and the transfer of said group into the outer pack comprises sliding said group over the bottom of said cassette.

6. The method according to claim 1, wherein said movement of said sub-groups comprises a rotation.

7. A system for packing a plurality of flexible packs containing at least some product in a box, comprising:

a feed configured for providing the plurality of flexible packs;

a cassette configured for receiving a number of the plurality of flexible packs, forming the packs into a group, and delivering the group from the cassette into the box;

a device configured for receiving a number of the plurality of flexible packs, arranging said packs into a group, and delivering said group into the box other than said cassette device, said device including:

two bottom portions;

a plurality of side walls, each adjacent to one of the bottom portions;

a plurality of corners, each corresponding between each of the bottom portions and side walls; and a moveable member connecting the two bottom portions, said two bottom portions and plurality of side walls being movable in such a way between one of a receiving position and a formation position, wherein in the receiving position said flexible packs rest essentially on said plurality of side walls with said plurality of corners being proximate to each other and in the formation position said plurality of flexible packs rest essentially on said bottom with said plurality of corners being remote from each other.

8. The system according to claim 7, wherein said moveable member provides said bottom portions and said plurality of side walls to be moved through an angle of at least 60°.

9. The system according to claim 7, wherein said formation position corresponds to a transfer position for removing said plurality of flexible packs from the cassette.

10. The system according to claim 7, wherein said two bottom portions can rotate with respect to one another by said movable member.

11. The system according to claim 7, wherein said movable member includes a hinge.

12. The system according to claim 11, wherein said two bottom portions are hinged near a free end away from said side walls.

13. The system according to claim 11, wherein said two bottom portions are connected together solely by the hinge.

14. The system according to claim 7, wherein at least one of said two bottom portions and said plurality of side walls are provided with means for gripping flexible packs.

15. The system according to claim 14, wherein said means for gripping comprise suction cups.

16. A system for packing a plurality of flexible packs containing at lease some product in a box, comprising:

a feed configured for providing the plurality of flexible packs;

a cassette configured for receiving a number of the plurality of flexible packs, forming the packs into a group, and delivering the group from the cassette into the box;

a device configured for receiving a number of the plurality of flexible packs, arranging said packs into a group, and delivering said group into the box other than said cassette device, said device including:

a bottom;

a plurality of side walls adjacent to the bottom; and a plurality of corners corresponding between the bottom and side walls, wherein said plurality of side walls being pivotable and have a discharge extremity adjacent to said bottom and a pivot extremity remote from said bottom, and wherein said bottom and plurality of side walls being movable by said pivot extremity in such a way between one of a receiving position and a formation position, that in the receiving position said flexible packs rest essentially on said plurality of side walls with said plurality of corners being proximate to each other, and in the formation position said plurality of flexible packs rest essentially on said bottom with said plurality of corners being remote from each other.

17. The system according to claim 16, wherein said formation position corresponds to a transfer position for removing said plurality of flexible packs from the cassette.

18. The system according to claim 17, wherein at least one robot is provided for at least one of said bottom part and said plurality of side walls.

19. The system according to claim 16, wherein at least one of said bottom and said plurality of side walls are provided with means for gripping flexible packs.

20. The system according to claim 19, wherein said means for gripping comprise cups.

21. A system for packing a plurality of flexible packs containing at least some product in a box, comprising:

a feed configured for providing the plurality of flexible packs;

a cassette configured for receiving a number of said plurality of flexible packs, forming said plurality of flexible packs into a group, and delivering said group from the cassette into the box other than said cassette, the cassette comprising:

a bottom;

a plurality of adjacent side walls; and a plurality of corresponding corners between the bottom and the plurality of side walls, wherein said corners of said cassette can be moved relative to one another from a pick-up position when receiving said plurality of flexible packs to a formation position for the formation of said group of the plurality of flexible packs, that in the receiving position said plurality of flexible packs rest essentially on said plurality of side walls with said corners being proximate to each other, and in the formation position said plurality of flexible packs rest essentially on said bottom with said corners being remote from each other, wherein said bottom comprises two bottom parts that can be moved relative to one another, wherein each side wall is joined to one of the two bottom parts, and a carrier for outer ones of said group of the plurality of flexible packs.

22. The system according to claim 21, wherein said feed comprises a robot which transfers the plurality of flexible packs to said cassette.

23. A system for packing a plurality of flexible packs containing at least some product in a box, comprising:

a feed configured for providing the plurality of flexible packs;

a cassette configured for receiving a number of the plurality of flexible packs, forming said plurality of flexible packs into a group, and delivering said group from the box into the box other than said cassette, the cassette comprising:

a bottom;

a plurality of adjacent side walls; and corresponding corners between the bottom and side walls, wherein said corners of said cassette can be moved relative to one another from a receiving position when receiving said plurality of flexible packs to a formation position for the formation of said group of the plurality of flexible packs, that in the receiving position said plurality of flexible packs rest essentially on said side walls with said corners being proximate to each other, and in the formation position said plurality of flexible packs rest essentially on said bottom with said corners being remote from each other, and wherein said plurality of side walls being pivotable and have a discharge extremity adjacent to said bottom and a pivot extremity remote from said bottom and a carrier for outer packs.

24. The system according to claim 23, wherein said feed comprises a robot, which transfers the plurality of flexible packs to said cassette.

25. The system according to claim 24, wherein there is always one robot for a bottom-side wall.

* * * * *